US005946927A

United States Patent [19]

Dieckmann et al.

[11] Patent Number: 5,946,927

[45] Date of Patent: Sep. 7, 1999

[54] HEAT PUMP WATER HEATER AND STORAGE TANK ASSEMBLY

[75] Inventors: John T. Dieckmann, Belmont; Brian J. Nowicki, Watertown; W. Peter Teagan, Acton; Robert Zogg, Belmont, all of Mass.

[73] Assignee: Arthur D. Little, Inc., Cambridge, Mass.

[21] Appl. No.: 09/059,878

[22] Filed: Apr. 14, 1998

[51] Int. Cl.[6] ..... F25B 27/00; G05D 23/00

[52] U.S. Cl. ..... 62/238.6; 237/2 B

[58] Field of Search ..... 62/238.6, 324.4; 237/2 B

[56] References Cited

U.S. PATENT DOCUMENTS

| | | | |
|---|---|---|---|
| 2,516,094 | 7/1950 | Ruff | 62/129 |
| 2,575,325 | 11/1951 | Ambrose et al. | 62/6 |
| 2,597,745 | 5/1952 | Morrison | 62/116 |
| 2,696,085 | 12/1954 | Ruff | 62/4 |
| 2,716,866 | 9/1955 | Silva | 62/238.6 |
| 4,091,994 | 5/1978 | Maden | 237/2 B |
| 4,290,275 | 9/1981 | Disco | 62/238.6 |
| 4,351,159 | 9/1982 | Schumacher | 62/79 |
| 4,363,221 | 12/1982 | Singh | 62/238.6 |
| 4,406,137 | 9/1983 | Demuth et al. | 62/238.6 |
| 4,627,483 | 12/1986 | Harshbarger, III | 237/2 B |
| 4,747,273 | 5/1988 | Cook et al. | 62/238.6 |
| 4,852,366 | 8/1989 | Harris | 62/238.6 |
| 4,959,975 | 10/1990 | Harris | 62/238.6 |
| 5,052,187 | 10/1991 | Robinson, Jr. | 62/79 |

*Primary Examiner*—Henry Bennett
*Assistant Examiner*—Melvin Jones
*Attorney, Agent, or Firm*—Pandiscio & Pandiscio

[57] ABSTRACT

A water heater and storage tank assembly comprises a housing defining a chamber, an inlet for admitting cold water to the chamber, and an outlet for permitting flow of hot water from the chamber. A compressor is mounted on the housing and is removed from the chamber. A condenser comprises a tube adapted to receive refrigerant from the compressor, and winding around the chamber to impart heat to water in the chamber. An evaporator is mounted on the housing and removed from the chamber, the evaporator being adapted to receive refrigerant from the condenser and to discharge refrigerant to conduits in communication with the compressor. An electric resistance element extends into the chamber, and a thermostat is disposed in the chamber and is operative to sense water temperature and to actuate the resistance element upon the water temperature dropping to a selected level. The assembly includes a first connection at an external end of the inlet, a second connection at an external end of the outlet, and a third connection for connecting the resistance element, compressor and evaporator to an electrical power source.

17 Claims, 5 Drawing Sheets

HEAT PUMP WATER HEATER AND STORAGE TANK ASSEMBLY

STATEMENT OF GOVERNMENT INTEREST

This invention was made with Government support under Contract No. DE-AC01-90 CE 23821, awarded by the U.S. Department of Energy. The Government has certain rights in this invention.

BACKGROUND OF THE INVENTION

1. Field of the Invention

The invention relates to water heater and storage tank assemblies, and is directed more particularly to such an assembly of the heat pump type.

2. Description of the Prior Art

A widely accepted and used water heater for residential hot water production and storage is the electric resistance water heater and storage tank. Referring to FIG. 1, it will be seen that such water heaters typically include a tank 20 defining a chamber 22 for retention of water. A water inlet pipe 24 is provided with a first connection 25 for interconnection with a cold water supply line (not shown) and conveys fresh relatively cold water into the chamber 22. Electric resistance elements 26 heat the water in the tank. A hot water outlet pipe 28, provided with a second connection 29 for interconnection with a hot water discharge line (not shown), conveys relatively hot water from the chamber 22. A pressure and temperature relief valve 34 is provided at the top or side of the tank 20 and typically is connected to a pressure and temperature relief valve drain tube 36 extending downwardly alongside the tank 20. An electrical power line 30 is provided with an electrical connector 32 for connection to a power source (not shown), such as a high voltage household outlet, and provides electrical power to the electric resistance elements 26. Such electrically powered assemblies typically have an Energy Factor (a measure of efficiency) of about 0.86 for a 50 gallon tank. The assemblies are available in different sizes, usually 40–80 gallon capacity, most typically 40 or 50 gallon capacity, and are dimensioned for acceptance in residential basements, kitchens, closets, and the like. Typically, the cold water inlet and hot water outlet are disposed at the top of the tank, and the electrical power line is disposed at the top (as shown) or side of the tank.

Heat pump water heaters and storage tank assemblies are generally known in the art. In U.S. Pat. No. 2,516,094, issued Jul. 18, 1950, to A. W. Ruff, there is shown and described a heat pump water heater. In the Ruff assembly, a compressor and condenser are disposed within a water containing tank and an evaporator is disposed on top of the tank. These heat pump components occupy a large portion of the volume of the tank, leaving a limited volume for storage of water. The hot and cold water connections are on the side of the tank, the cold water inlet being near the bottom of the tank.

In U.S. Pat. No. 2,696,085, issued Dec. 6, 1954, to A. W. Ruff, there is disclosed a similar heat pump water heater differing from the '094 assembly in that the condenser portion of the refrigerant circuit comprises three sets of coils submerged high, low and midway inside the tank.

In U.S. Pat. No. 2,575,325, issued Nov. 20, 1951, to E. R. Ambrose et al, there is shown a heat pump water heater and storage tank in which a compressor and condenser are located within the tank and two evaporators are located externally of the tank.

While heat pump water heaters provide improved efficiencies over electric resistance water heaters, they have never attained wide acceptance. The reasons for the lack of acceptance appear to be (1) high initial costs; (2) the fact that water heater installers (a) are used to placement of hot water and cold water connections in about the same place relative to the tank, which typically is a 40 gallon or 50 gallon tank, and used to a single simple electrical connection, and (b) are not equipped to handle system components external to, and removed from, the tank; (3) the fact that often a water heater is located in a confined space which is constructed with enclosure of a 40 or 50 gallon residential electrical water heater of conventional shape in mind; and (4) the fact that heat pump water heaters can be slow to recover from a large draw-down of hot water.

It has been recognized by the U.S. Department of Energy that wide-spread acceptance of heat pump water heaters would lead to substantial savings in energy consumption.

There is thus a need for a heat pump water heater having substantially improved efficiencies over a comparable electric resistance water heater, having substantially the same physical characteristics as a comparable electric resistance water heater, and having connections that can easily be made by anyone practiced in installing electric resistance water heaters. There is further a need for such a heat pump water heater wherein provision is made for quick recovery from large draw-downs. There is still further a need for such a heat pump water heater which is comparable in initial cost to that of an electric resistance water heater.

SUMMARY OF THE INVENTION

An object of the invention is therefore, to provide a heat pump water heater exhibiting efficiencies substantially improved over comparable electric resistance water heaters.

A further object of the invention is to provide such a water heater which is of substantially the same size and configuration as a comparable electric water heater, is provided with water and electrical connections disposed similarly to such connections in electric water heaters, and wherein the heat pump components are fully integrated with the tank, such that the heat pump water heater may readily be substituted for an electric water heater without a requirement for an installer having specialized skills for heat pump water heater installation.

A still further object of the invention is to provide such a heat pump water heater having facility for quickly reacting to large draw-downs, so as to promptly reestablish a heated condition for water in the tank.

A still further object of the invention is to provide such a heat pump water heater as is competitively priced relative to a comparable electric resistance water heater.

With the above and other objects in view, as will hereinafter appear, a feature of the present invention is the provision of a water heater and storage tank assembly comprising a housing defining a chamber for retaining water. An inlet pipe extends through the housing and into the chamber for admitting relatively cold water to the chamber and an outlet pipe extends through the housing for permitting flow of relatively hot water from the chamber. A compressor is mounted proximate and removed from the chamber, the compressor being adapted to receive refrigerant, to compress the refrigerant, and to discharge the refrigerant in a hot state. A condenser comprises one or more tubes adjacent the chamber and in thermal contact with the chamber, the tubes being adapted to receive the hot refrigerant from the compressor, and adapted to impart heat to water in the chamber adjacent the. An evaporator is mounted on the housing and removed from the chamber, the evaporator being adapted to receive cooled refrigerant from the condenser and comprising coils adjacent atmosphere external to the housing. The evaporator is adapted to discharge refrigerant to conduits in communication with the compressor for directing refrigerant from the evaporator to the compressor. An electric resistance element extends into the chamber, and a thermostat is disposed proximate the chamber and is operative to sense temperature corresponding to water temperature in the chamber and to actuate the electric resistance element upon the water temperature dropping to a selected level. The assembly includes a first connection at an external end of the cold water inlet pipe, a second connection at an external end of the hot water outlet pipe, and a third connection for interconnecting the electric resistance element and an electrical power source.

The above and other features of the invention, including various novel details of construction and combinations of parts, will now be more particularly described with reference to the accompanying drawings and pointed out in the claims. It will be understood that the particular devices embodying the invention are shown by way of illustration only and not as limitations of the invention. The principles and features of this invention may be employed in various and numerous embodiments without departing from the scope of the invention.

BRIEF DESCRIPTION OF THE DRAWINGS

Reference is made to the accompanying drawings in which are shown illustrative embodiments of the invention, from which its novel features and advantages will be apparent.

In the drawings.

DESCRIPTION OF THE PREFERRED EMBODIMENTS

Figure 1:
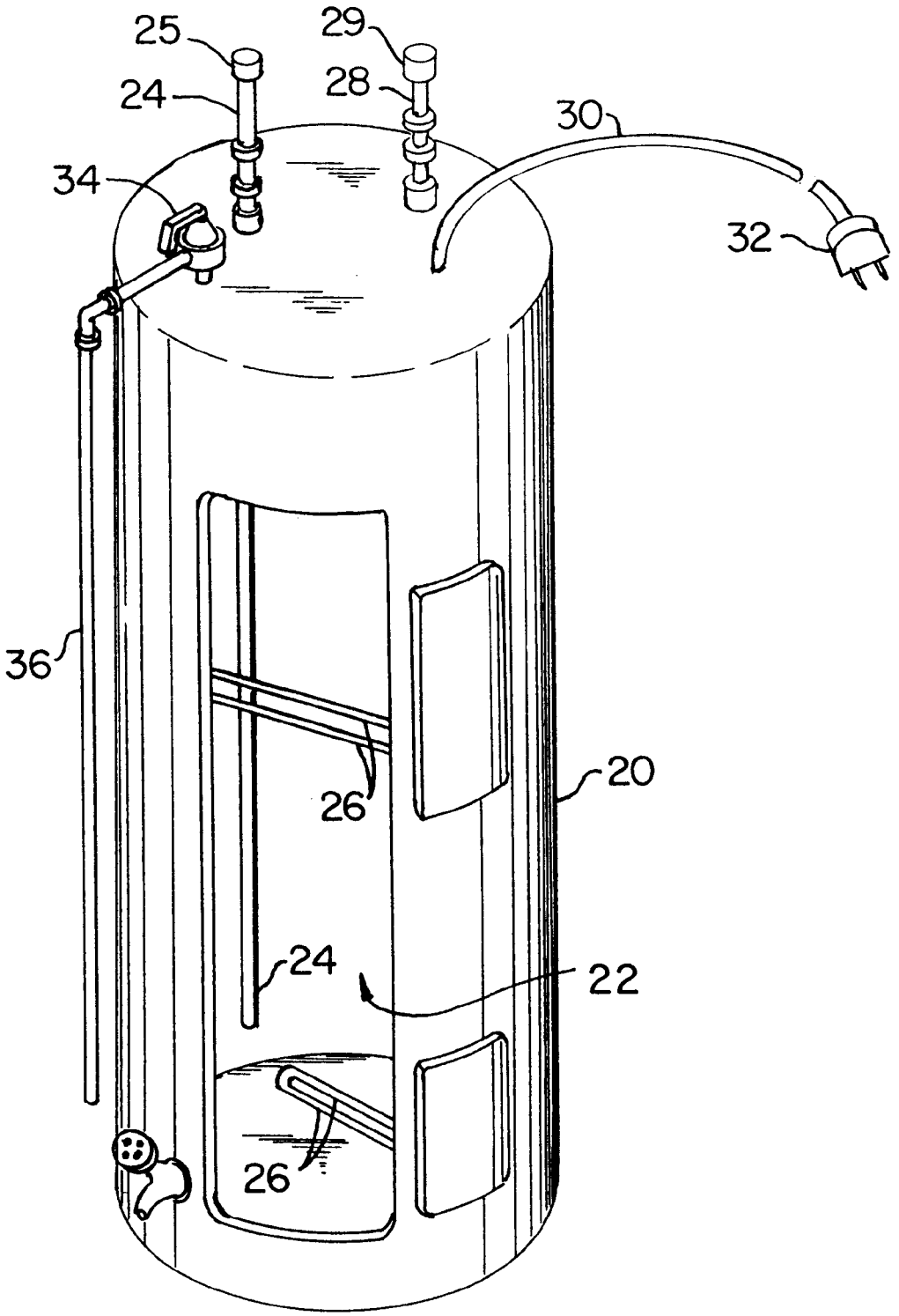
FIG. 1 PRIOR ART
FIG. 1 is a perspective, broken away, view of a prior art standard electric resistance water heater and storage tank assembly.

Referring to FIGS. 2–5, it will be seen that an illustrative heat pump water heater and storage tank assembly includes a housing 40 defining a chamber 42 for retaining water. An inlet pipe 44 extends through the housing 40 and into the chamber 42 for admitting relatively cold water to the chamber 42. An outlet pipe 46 extends through the housing 40 for permitting flow of relatively hot water from the chamber 42. The usual pressure and temperature relief valve 34 is mounted on the housing 40.

A compressor 50 is mounted on a bottom wall 52 of the housing 40 and is separated from the chamber 42 by a partition 54 which extends widthwise in the housing 40, defining one end of the chamber 42 and defining, in cooperation with the bottom wall 52 and housing side walls 56, a compartment 58. The compartment 58 is thus removed from the chamber 42 and houses the compressor 50. The compressor 50 is adapted to receive refrigerant, compress the refrigerant, and to discharge the refrigerant in a hot state.

Alternatively, the housing side walls 56 may end proximate the partition 54 and the housing may be supported by legs (not shown) extending beneath the housing side walls. In this case, the bottom wall 52 may be omitted and the compressor 50 may be supported by the surface supporting the legs.

Figure 3:
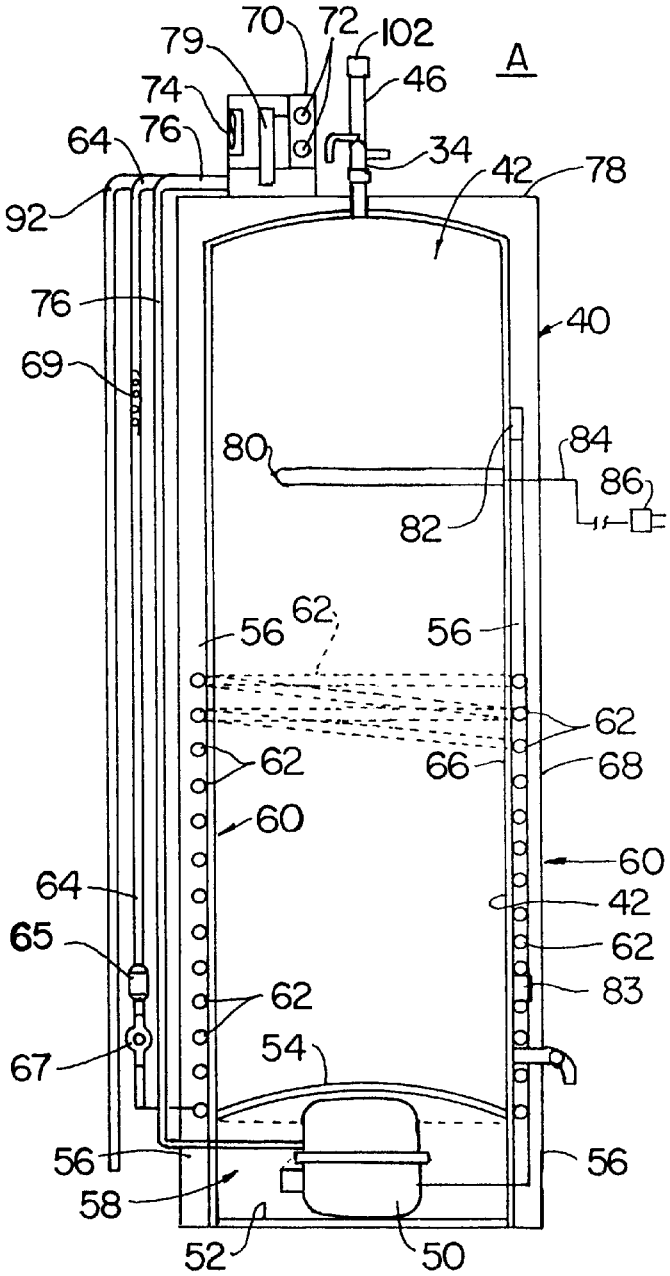
FIG. 3 is a sectional diagrammatic view of the inventive assembly taken generally along line III—III of FIG. 2.

A condenser 60 comprises one or more tubes 62 adjacent to, and preferably supported by, the side walls 56 of the housing 40. The condenser tube 62 preferably is disposed within the side walls 56 and adjacent the chamber 42. The tube 62 is disposed closer to an inside surface 66 of the housing side walls 56 than to an outside surface 68, as shown in FIG. 3, such that the heat supplied by the tube 62 radiates inwardly into the chamber 42. The tube 62 is adapted to receive the hot refrigerant from the compressor 50. The tube 62 winds around the chamber 42 and imparts heat to the water in the chamber. While the tube 62 is illustrated in FIG. 3 as being disposed in a generally spiral configuration, it will be appreciated that the tube 62 alternatively may be wound around the chamber 42 in a serpentine manner, or in any selected configuration for imparting heat to the water in the chamber 42 as desired. The tube 62 is in communication with a conduit 64 disposed along the housing side wall 56 and having a flow restriction device 69 therein. The flow restriction device 69 may be a thermostatic expansion valve, an orifice plate, or, preferably, a capillary tube, or the like. The conduit 64 may be provided with a filter 65 and/or a sightglass 67, as is known in the art.

An evaporator 70 is mounted on the housing 40, preferably at a top portion of the housing, and is removed from the chamber 42. The evaporator 70 is adapted to receive cooled refrigerant from the flow restriction device 69 in the conduit 64 extending from the condenser 60. The evaporator 70 includes coils 72 adjacent the atmosphere A external to the housing 40. The evaporator 70 may include a fan 74 for blowing air past the coils 72 and to the atmosphere A, cooling the atmosphere and warming the refrigerant in the coils 72. The coils 72 may be disposed above an upper end 78 of the housing 40, as shown in FIG. 3. The evaporator 70 is adapted to discharge refrigerant to a conduit 76 mounted on the housing side wall 56 and in communication with the compressor 50. In the conduit 76 is disposed an accumulator 79 which serves as a reservoir for liquid refrigerant.

The assembly further includes at least one electric resistance element 80 extending into the chamber 42 and preferably mounted on the housing side wall 56 in an upper portion of the chamber 42, between the condenser 60 and the evaporator 70. A thermostat 82 is disposed proximate the chamber 42, and preferably is mounted in the side wall 56 near the resistance element 80. The thermostat 82 is operative to sense the temperature of the housing wall 56, which substantially corresponds to the water temperature in the chamber 42, and to actuate the resistance element 80 upon dropping of the water temperature to a selected level. Thus, in the case of a rapid draw-down of hot water, the water temperature in the chamber drops precipitously, which causes cooling of the wall temperature, which is detected by the thermostat 82, which operates to turn on the resistance element 80 to boost heating of the water in the chamber 42. The thermostat 82 is a standard readily available thermostat.

A second thermostat 83 is similarly disposed in side wall 56, preferably in a lower region of the chamber 42, and is similarly operative to sense the temperature of the housing wall 56 and, in response thereto, to terminate electrical power to the compressor 50 and the evaporator fan 74 upon the sensed temperature rising to a selected level, and to activate electrical power to the compressor and evaporator fan upon the sensed temperature dropping to a selected level. The thermostat 83 is a standard readily available thermostat. Thus, the thermostats 82, 83 are both simple and inexpensive devices which operate to control the temperature of the water in the chamber 42.

In a preferred embodiment of the invention, the evaporator 70 is adapted to operate without causing formation of condensation. Alternatively, there may be provided a condensate drain tube 92 (FIGS. 2 and 3) for delivering condensate to a household drain line or other receptacle, such as a condensate pan (not shown). There may be provided in connection with the condensate pan, a re-evaporation assembly (not shown) for evaporating the condensate collected in the condensate pan. Alternatively, there may be provided in the pan a trip switch (not shown) actuated by the presence of condensate in the pan to shut off the evaporator 70. In still another embodiment there is provided a sensor and microprocessor (not shown) for detection of the formation of condensate by the evaporator 70 and operative to shut off the evaporator.

The upper end of the inlet pipe 44 is provided with a first connection 100 for interconnection with a cold water supply line (not shown). Similarly, the upper end of the outlet pipe 46 is provided with a second connection 102 for interconnection with a hot water discharge line (not shown). The first connection 100 is disposed at about the same place as the first connection 25 of the electric resistance heater of FIG. 1, and the second connection 102 is disposed at about the same place as the second connection 29 of the electric resistance heater of FIG. 1.

Figure 5:
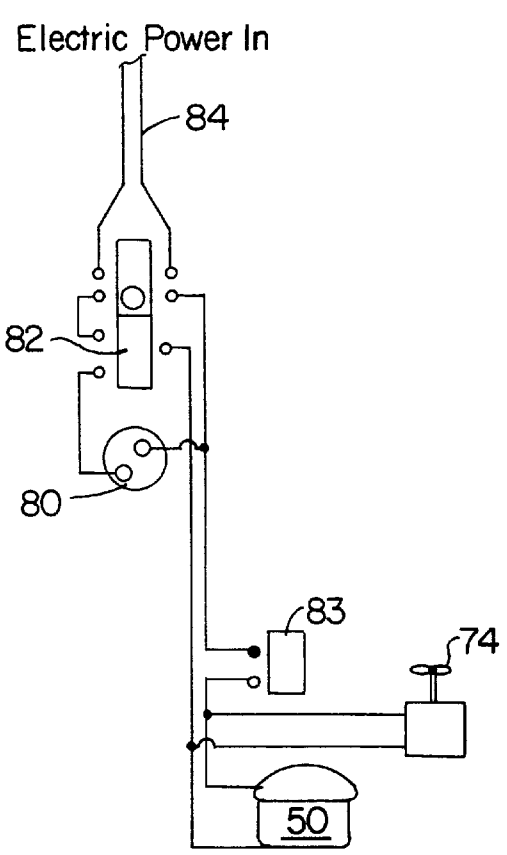
FIG. 5 is a schematic diagram illustrative of the electrical system for the water heater assembly of FIGS. 2 and 3.
Figure 4:
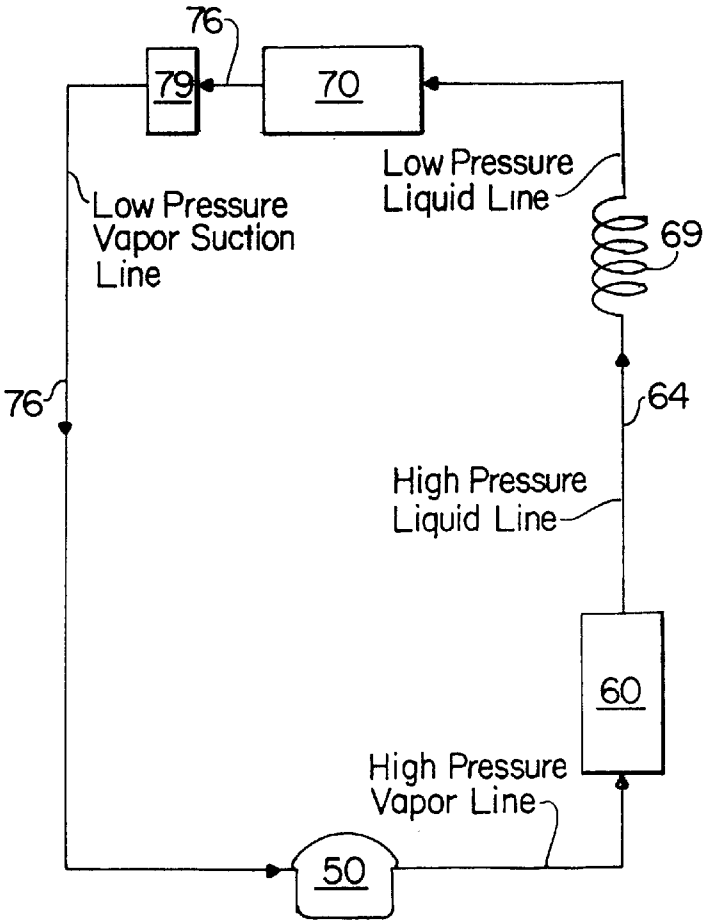
FIG. 4 is a schematic diagram illustrative of the heat pump system shown in FIGS. 2 and 3.

The electric resistance element 80 is provided with an electrically conductive line 84, shown schematically in FIG. 5, and having an electrical connector 86 (FIG. 3) for connection to a power source, such as a 220 volt household outlet, similar to electrical connector 32 of the water heater of FIG. 1. Thus, a water heater installer familiar with the hot and cold water connections and the single electrical connection, can readily install the heat pump water heater in place of an electric resistance water heater. While the electrical connector 32 shown in FIG. 1 and the electrical connector 86 shown in FIG. 3 are each illustrated as a common male connector, it will be appreciated that water heaters often are hard-wired to a power source and that the connectors 32, 86 are merely representative of electric line terminal portions adapted for connection to the power source.

In installation of the above-described heat pump water heater assembly in place of the above-described commonly used prior art electric resistance water heater, the latter is disconnected at the first and second connections 25, 29 and at the electrical connector 32 and taken away. The heat pump water heater is placed in the location formerly occupied by the electric resistance water heater. The first and second connections 100, 102 are connected to the cold water and hot water pipes (not shown) to which the electric resistance water heater connections 25, 29 were formerly connected. The electric connector 86 is connected to the power source (not shown) to which the electrical connector 32 was formerly connected. In new construction situations, the heat pump water heater described herein is installed virtually identically to the installation of an electric resistance water heater.

In start-up operation, cold water is admitted to the chamber 42 through the inlet pipe 44. The heat pump circuit is energized through electrical lines disposed in the housing walls (shown schematically in FIG. 5) and in communication with the electrical line 84. The thermostat 82 detects the cold temperature of the water in the chamber 42 and activates the electrical resistance element 80. The second thermostat 83 similarly detects the cold temperature of the water in the chamber 42 and activates the compressor 50 and evaporator 70, thus starting operation of the heat pump system. The water in the chamber 42 is heated by the resistance element 80 and by the compressor 50 which heats the partition 54 which, in turn, imparts heat to the water. The water in the chamber 42 is further heated by the condenser tube 62 carrying hot refrigerant from the compressor 50. Upon the water in the chamber 42 reaching a selected temperature, the thermostat 82 shuts down the electric resistance element 80 and the thermostat 83 shuts down the heat pump system. The water temperature is then maintained by periodic operation of the heat pump system which requires only sufficient electrical power to run the compressor 50 and evaporator fan 74.

As water is drawn from the assembly, the heat pump system operates, in known fashion, to raise the temperature of the water in the chamber 42, cooled by incoming cold water replacing the outgoing hot water, to a selected temperature. In the event of a large draw-down of hot water, the resistance element 80 activates and assists the heat pump system in reestablishing the selected temperature.

The heat pump components of the system above described are relatively commonly used, relatively inexpensive, components. For example, the compressor 50 preferably is a small hermetic compressor of the type commonly used in domestic refrigerators, and is of about 800–1300 BTU/hr. nominal capacity for a 40 or 50 gallon tank. The small capacity compressor 50 draws little electrical power, allowing the electric resistance element 80 and the heat pump system to operate simultaneously. The evaporator 70 is a forced convection finned-tube evaporator or a natural gill convection evaporator. The condenser tube 62 preferably is of ¼ inch outside diameter and is of copper or aluminum. The capillary tube 69 is sized to limit the refrigerant flow rate to the relatively low compressor capacity at the maximum rated evaporator temperature, allowing operation at higher ambient temperature without overloading the compressor. The system, by heat pump standards, is of low heating capacity, which is required to enable use of low cost components, but which also affords reliability through system simplicity. The condenser tube 62, the inside surface 66, and the partition 54, in combination, impart heat to the water in the chamber 42 at a rate of no more than about 5000 BTU/hr., permitting use of a compressor of the type described above and having the aforesaid capacity of no more than about 1300 BTU/hr. at refrigerator compressor rating conditions of −10° F. evaporating temperature and 130° F. condensing temperature. The condenser 60 eliminates the usual requirement of a double-walled condenser, is not submerged in the tank, and requires no costly tank modifications.

It will be noted that the heat pump system herein described does not include a water circulating pump. Having no requirement for a water circulating pump contributes to low costs in manufacture and consumer purchase, but also represents a substantial contribution to subsequent low maintenance and repair costs.

It is desirable that the compressor 50 be a domestic refrigerator type compressor inasmuch as this type of compressor is produced in the largest volumes of any commercially produced refrigerant compressor and is consequently the least expensive and most readily available refrigerant compressor. However, over the range of heat pump water heater operating conditions, especially at higher water temperatures, the motor (not shown) in this type of compressor could operate at an overload and may tend to overheat. A novel approach to capillary tube refrigerant flow control is used herein to provide extra cooling to the compressor motor by returning liquid refrigerant to the compressor 50, along with the vapor returning from the evaporator 70. The capillary tube restriction 69, the refrigerant charge quantity, and the accumulator 79 interact such that at low water temperatures sufficient refrigerant flows to the evaporator 70 such that by boiling and superheating, the heat extracted from the air is absorbed by the refrigerant. When the water temperature, and the corresponding condenser temperature and pressure, increase to levels that could result in compressor motor overheating, the increased pressure results in increased flow through the capillary tube 69 and a transfer of refrigerant charge from the condenser 60 to the low pressure (evaporator) side of the system. Consequently, more refrigerant flows through the evaporator 70 than can be evaporated by the heat extracted from the air by the evaporator 70. The excess refrigerant flows to the compressor 50 and directly cools the motor windings.

Inasmuch as the heat pump system herein described is of low capacity, which normally requires a long time to recover from a draw that substantially or fully exhausts the supply of stored hot water, the resistance element 80, having a conventional capacity of 4,500 watts, is needed to provide a shortened recovery time. If desired, a second resistance element (not shown) can be added to the assembly for even faster recovery time.

Aside from attaining an Energy Factor of about 1.5 to 2.0, the above-described system tolerates a wide range of evaporating and condensing temperatures, allowing operation in low ambient temperatures. Accordingly, operation is feasible in unheated spaces such as attics, garages, carports, crawl spaces, and the like, even in cold weather.

It has been determined by analysis that the cost of the above-described assembly with a 50 gallon capacity exceeds the cost of a conventional standard electric resistance water heater with a 40 gallon capacity by about $260. The potential energy cost savings have been determined to range from about $75/year for an average household to about $400/year for a large household. Thus, payback periods are expected to be about 3½ years for average households, and about 8 months for large households.

Figure 6:
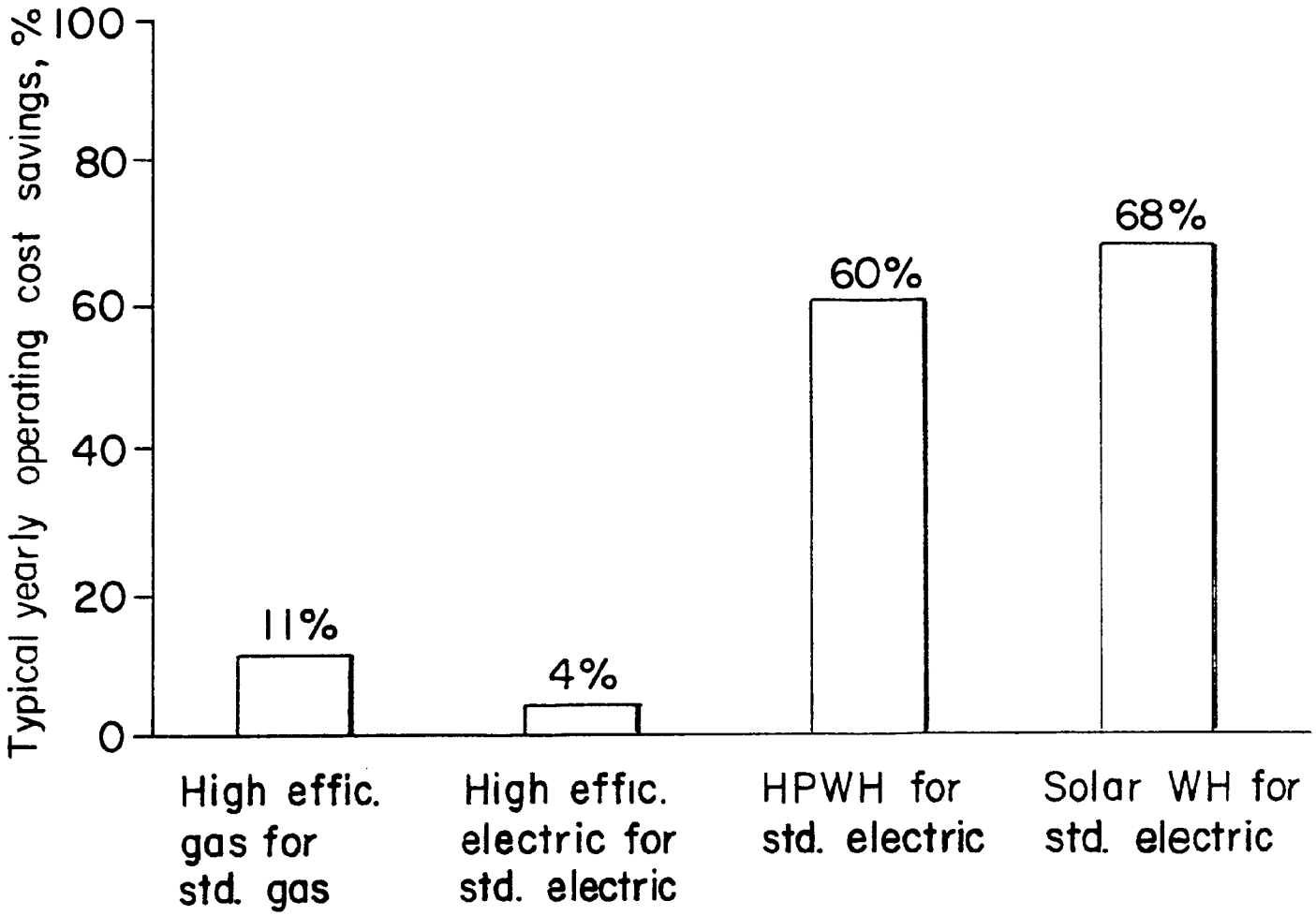
FIG. 6 is a graph showing typical water heater operating cost savings realized by using water heaters other than standard water heaters.

In FIG. 6, there are shown typical yearly operating cost savings realized by the substitution of more efficient water heaters for standard water heaters. As shown in the FIG. 6 graph, by substituting a "high efficiency" electric resistance water heater for a standard electric resistance water heater, one may reduce operating costs per year by about 4%, and by substituting a "high efficiency" gas water heater for a standard gas heater, one may realize an 11% operating cost savings. However, by substituting the herein-described heat pump water heater for a standard electric resistance water heater, one may realize a savings of about 60% in annual operating costs. The heat pump water heater savings is exceeded only by the substitution of a solar water heater, which requires more expensive components and extensive installation skills usually not possessed by typical water heater installers. The savings noted in FIG. 6 are based on typical yearly operating costs for a family of four.

Figure 2:
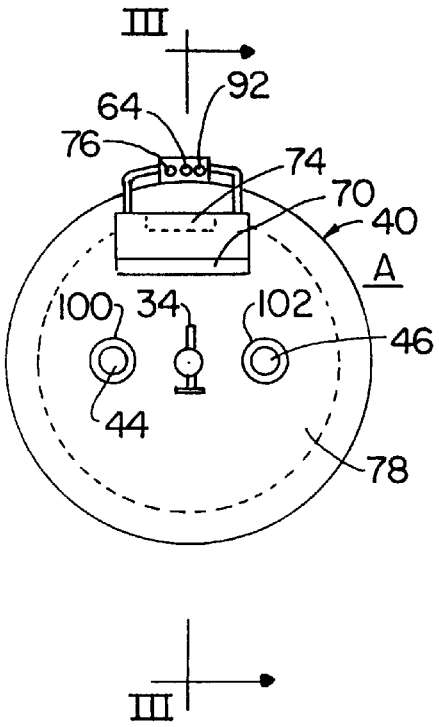
FIG. 2 is a top plan diagrammatic view of one form of heat pump water heater and storage tank assembly illustrative of an embodiment of the invention.
Figure 8:
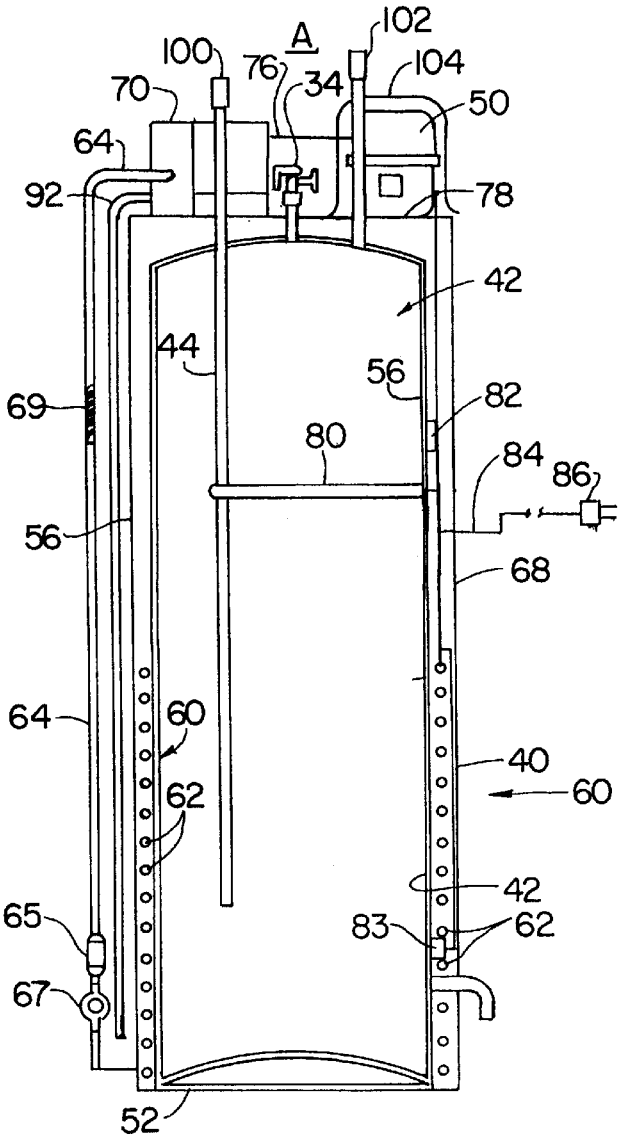
FIG. 8 is a sectional diagrammatic view taken generally along line VIII—VIII of FIG. 7.
Figure 7:
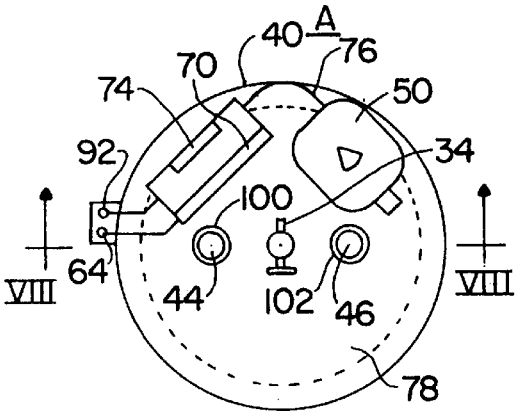
FIG. 7 is a top plan diagrammatic view of an alternative embodiment of the inventive assembly.

Referring to FIGS. 7 and 8, it will be seen that in an alternative embodiment components are arranged similarly to the arrangement shown in FIGS. 2 and 3, except that the compressor 50 is disposed on the housing upper end 78. This alternative arrangement reduces the cost of the assembly and increases the volume of the chamber 42 without substantially increasing the space required by the assembly. Further, the alternative arrangement simplifies maintenance and repair. However, in this embodiment the water in the chamber 42 does not receive the benefit of heat radiated from the compressor 50 or the compressor-heated partition 54. Accordingly, it is expected that a slight reduction in efficiency may be realized. If heat radiation and convection from the compressor 50 is deemed likely to present a problem in a specific application, a shield 104 (FIG. 8) may be mounted around the compressor. The installation and operation of the embodiment of FIGS. 7 and 8 is substantially the same as described above with respect to the embodiment of FIGS. 2–5.

There is thus provided a heat pump water heater and storage tank assembly of reasonable initial cost compared to an electric resistance water heater, requiring installation very similar to the installation of the electric resistance water heater, and which is adapted for placement in virtually any place occupied by an electric resistance water heater. The assembly further is adapted to provide highly efficient operation, having an Energy Factor of about 1.5 to 2.0, and to provide an acceptable recovery time after a large hot water draw-down.

It is to be understood that the present invention is by no means limited to the particular constructions herein disclosed and/or shown in the drawings, but also comprises any modifications or equivalents within the scope of the claims.

What is claimed is:

1. A water heater and storage tank assembly comprising:

a housing defining a chamber for retaining water;

an inlet pipe extending through said housing and into the chamber for admitting relatively cold water to the chamber;

an outlet pipe extending through said housing for permitting flow relatively hot water from the chamber;

a compressor mounted proximate and removed from the chamber, said compressor being adapted to receive refrigerant, to compress the refrigerant and to discharge the refrigerant in a hot state;

a condenser comprising at least one tube adjacent the chamber and in thermal contact with the chamber, said tube being adapted to receive the hot refrigerant from said compressor, and adapted to impart heat to water in the chamber adjacent said tube;

an evaporator mounted on said housing and removed from the chamber, said evaporator being adapted to receive cooled refrigerant from said condenser and comprising coils adjacent atmosphere external to said housing, said evaporator being adapted to discharge refrigerant to conduits in communication with said compressor for directing refrigerant from said evaporator to said compressor;

a flow restriction device mounted between said condenser and said evaporator for limiting flow of the cooled refrigerant from said condenser to said evaporator;

an electric resistance element extending into the chamber;

a first thermostat disposed on said housing and operative to sense temperature corresponding to water temperature in the chamber and to actuate said electrical resistance element upon the water temperature dropping to a selected level;

a second thermostat disposed on said housing and operative to sense the temperature corresponding to the water temperature in the chamber and to actuate said compressor and said evaporator upon the water temperature dropping to a selected level;

said assembly having a first connection at an external end of said cold water inlet pipe, a second connection at an external end of said hot water outlet pipe, and a third connection for connecting said electric resistance element and said compressor with an electrical power source; and a partition extending widthwise in said housing and defining a bottom end of the chamber, said compressor being disposed adjacent a side of said partition removed from the chamber, said condenser tube extending within said housing walls from proximate said partition.

2. The assembly in accordance with claim 1 wherein said partition defines in part a compartment removed from the chamber, said compressor being disposed in the compartment.

3. The assembly in accordance with claim 1 wherein said at least one condenser tube is supported by walls of said housing and winds around said chamber.

4. The assembly in accordance with claim 3 wherein said condenser tube extends within said housing walls.

5. The assembly in accordance with claim 1 wherein said electric resistance element is disposed closer than said condenser to a top end of said chamber.

6. The assembly in accordance with claim 5 wherein said electric resistance element is disposed closer to an upper end of said chamber than to a lower end of said chamber.

7. The assembly in accordance with claim 1 wherein said evaporator is in communication with said compressor through said conduits, said conduits being disposed along walls of said housing for directing said refrigerant from said evaporator to said compressor.

8. The assembly in accordance with claim 5 wherein said conduits are mounted on said walls of said housing.

9. The assembly in accordance with claim 1 wherein said compressor is disposed adjacent said chamber and is adapted to impart heat to water in said chamber.

10. A water heater and storage tank assembly comprising:

a housing defining a chamber for retaining water;

an inlet pipe extending through said housing and into the chamber for admitting relatively cold water to the chamber;

an outlet pipe extending through said housing for permitting flow of relatively hot water from the chamber;

a compressor mounted proximate and removed from the chamber, said compressor being adapted to receive refrigerant, to compress the refrigerant, and to discharge the refrigerant in a hot state;

a condenser comprising at least one tube embedded in side walls of said housing adjacent the chamber and in thermal contact with the chamber, said tube being adapted to receive said hot refrigerant from said compressor, and adapted to impart heat to water in the chamber adjacent said tube;

an evaporator mounted on said housing and removed from the chamber, said evaporator being adapted to receive cooled refrigerant from said condenser and comprising coils adjacent atmosphere external to said housing, said evaporator being adapted to discharge refrigerant to conduits in communication with said compressor for directing refrigerant from said evaporator to said compressor;

a flow restriction device mounted between said condenser and said evaporator for limiting flow of the cooled refrigerant from said condenser to said evaporator;

an electric resistance element extending into the chamber;

a first thermostat disposed on said housing and operative to sense temperature corresponding to water temperature in the chamber and to actuate said electrical resistance element upon the water temperature dropping to a selected level; and a second thermostat disposed on said housing and operative to sense the temperature corresponding to the water temperature in the chamber and to actuate said compressor and said evaporator upon the water temperature dropping to a selected level;

said assembly having a first connection at an external end of said cold water inlet pipe, a second connection at an external end of said hot water outlet pipe, and a third connection for connecting said electric resistance element and said compressor with an electrical power source.

11. The assembly in accordance with claim 10 wherein said compressor is a domestic refrigerator type compressor having a nominal capacity of no more than about 1300 BTU/hour at refrigerator compressor rating conditions of −10° F. evaporating temperature and 130° F. condensing temperature.

12. The assembly in accordance with claim 10 wherein said assembly further comprises a condensate drain tube for delivering condensate from said evaporator.

13. The assembly in accordance with claim 10 wherein said assembly is devoid of a water circulating pump.

14. The assembly in accordance with claim 2 wherein said condenser tube and said partition impart heat to water in said chamber at a rate of no more than about 5000 BTU/hr. and said compressor has a nominal capacity of no more than about 1300 BTU/hour at refrigerator compressor rating conditions of −10° F. evaporating temperature and 130° F. condensing temperature.

15. The assembly in accordance with claim 10 wherein said assembly, less said electric resistance element, imparts heat to the water in said chamber at a rate of no more than about 5000 BTU/hr.

16. The assembly in accordance with claim 10 wherein said evaporator is a natural convection evaporator.

17. The assembly in accordance with claim 10 wherein said condenser tube is disposed closer to an inside surface of said walls of said housing than to an outside surface of said walls of said housing.

* * * * *